US005201604A

United States Patent [19]

Ferguson et al.

[11] Patent Number: 5,201,604

[45] Date of Patent: Apr. 13, 1993

[54] FIELD CONFIGURABLE SONIC GRADE CONTROL

[75] Inventors: Christopher Ferguson, Framingham, Mass.; Joseph E. Musil, Ely, Iowa

[73] Assignee: Raytheon Company, Lexington, Mass.

[21] Appl. No.: 738,060

[22] Filed: Jul. 30, 1991

[51] Int. Cl.[5] ..... E01C 19/18

[52] U.S. Cl. ..... 404/110; 404/84.5

[58] Field of Search ..... 404/84, 75, 90, 108, 404/110; 364/427.07, 561-563; 367/88; 73/861.18, 105, 146, 628-629; 340/621, 600; 37/DIG. 18, DIG. 1, DIG. 20

[56] References Cited

U.S. PATENT DOCUMENTS

| | | | |
|---|---|---|---|
| 3,886,487 | 5/1975 | Walsh et al. | 367/100 X |
| 3,924,461 | 12/1975 | Stover | 33/523.2 X |
| 4,361,202 | 11/1982 | Minovitch | 364/426.04 X |
| 4,750,117 | 6/1988 | Gregory | 364/563 |
| 4,751,645 | 6/1988 | Abrans et al. | 367/88 X |
| 4,810,022 | 3/1989 | Takagi et al. | 364/424.05 X |
| 4,823,366 | 4/1989 | Williams | 404/84.5 X |
| 4,933,853 | 6/1990 | Musil et al. . | |
| 4,943,119 | 7/1990 | Zarniko et al. | 404/84.5 X |
| 5,009,546 | 4/1991 | Domenighetti et al. | 404/84.5 X |
| 5,039,249 | 8/1991 | Hansen et al. | 404/84.5 |
| 5,100,277 | 3/1992 | Musil | 404/108 X |

*Primary Examiner*—Ramon S. Britts

*Assistant Examiner*—Nancy P. Connolly

*Attorney, Agent, or Firm*—William R. Clark; Richard M. Sharkansky

[57] ABSTRACT

A sonic grade control device for maintaining a leveling instrument of a paver at a constant distance from a datum. The device transmits and receives a sonic signal to provide first and second time periods corresponding to the round trip travel time of a sonic signal to the datum and a target, respectively. A distance indicating signal, corresponding to the distance between the control device and the datum, is provided in response to the first and second time periods and a stored target distance, such target distance corresponding to the distance between the control device and the target. The grade control device includes an operator actuable control for modifying the stored target distance to calibrate the control device. A reference signal is compared to the distance indicating signal to provide a control signal. The reference signal is adjustable by a predetermined increment and the control device includes an operator actuable control for modifying the predetermined increment. The position of the leveling instrument is changed in response to the control signal being greater than a predetermined, or deadband value. The control device includes a display for indicating such predetermined value and an operator actuable control for modifying such value.

11 Claims, 5 Drawing Sheets

FIELD CONFIGURABLE SONIC GRADE CONTROL

BACKGROUND OF THE INVENTION

This invention relates generally to road construction apparatus and more particularly to a field configurable device for controlling the position of a road leveling instrument.

As is known in the art, road paving apparatus generally includes a leveling, or grading instrument to provide a smooth surface of asphalt over the road bed. The leveling instrument, often referred to as a screed, is a free floating instrument which is towed behind the paver. More particularly, each of a pair of screed positioning members has a first end coupled the paver and a second end attached to the leveling instrument. As the paver moves, the leveling instrument moves over asphalt deposited by the paver onto the road bed in order to provide a smooth road surface.

As is also known in the art, the thickness of asphalt material on the road bed is increased or decreased by raising or lowering the position of the leveling instrument, respectively. Generally, the first end of each of the pair of screed positioning members is coupled to the paver by hydraulic cylinders. The hydraulic cylinders allow the position, or height of the leveling instrument to be adjusted relative to the road bed. Thus, the movement of the hydraulic cylinders provides corresponding movement in the screed positioning members and consequently, in the position of the leveling instrument. Moreover, the hydraulic cylinders raise or lower the first end of the screed positioning members individually or in concert. For example, if the paved surface on the left side of the paver has a desired thickness but such surface on the right side of the paver is undesirably thin, the hydraulic cylinder disposed on the right side of the paver raises the corresponding screed positioning member. In this way, the position of the right side of the leveling instrument is raised and that of the left side is kept constant in order to achieve the desired asphalt thickness.

As is also known in the art, road paving apparatus often includes a grade control device which controls the hydraulic cylinders and, thus, the position of the leveling instrument above the road surface. The grade control device compares a reference distance (i.e. a preset distance corresponding to the distance between the control device and a reference surface, or datum) to a distance measured between the control device and the datum. In response to the difference between such distances, electrical control signals are generated which control solenoids in the hydraulic cylinders to move the leveling instrument upward or downward accordingly.

Typically, the datum is either a wire disposed at a predetermined distance above the road surface, a ski-like structure which drags along the road surface, or the road bed itself. The reference distance is preset by the operator of the paving equipment when the paver is set up, or initialized, prior to a paving operation. More particularly, the leveling instrument is, initially, manually adjusted to be disposed at a desired distance above the road bed (i.e. corresponding to a desired asphalt thickness). The reference distance is then set, for example, by activating a switch which causes the distance between the control device and the datum to be measured and stored in a memory device. In operation, the grade control device adjusts the position of the leveling instrument to maintain the set reference distance between the control device and the datum. In this way, the level of the grading instrument is maintained at a constant distance from the datum.

As is also known in the art, the distance between the control device and the datum may be measured in various manners. One way of making such a distance measurement is by using a contacting wand. With this arrangement, the wand drags along the datum and is displaced upward or downward depending on the level of such datum. However, the mechanical wand may become caught or jammed on obstacles on the road surface, for example, and thus, may not provide a reliable distance measurement.

An alternate way of measuring the distance between the control device and the datum is to use a non-contacting sonic device. Non-contacting measuring devices are desirable since they have fewer moveable parts and, thus, tend to be more reliable. An example of a grade control device employing sonic sensing is found in U.S. Pat. No. 4,933,853 entitled "Ultrasonic Grade and Auger Control". In the apparatus described therein, a sonic signal is transmitted from the control device downward to the datum and is received by such device after reflecting off the datum. The time between the transmission and receipt of the signal is measured and used to determine the distance between the control device and the datum. More particularly, a first time period is determined by measuring the time between transmission and receipt of a sonic signal directed toward the datum. A second time period corresponds to the time between transmission and receipt of a sonic signal directed toward a target disposed at a predetermined target distance from the control device. The distance between the control device and the datum is then determined by multiplying the ratio of the predetermined target distance (i.e. the distance between the control device and the target) to the second time period by the first time period. The above-described method of measuring the distance between the control device and the datum (i.e. in particular, the use of the target) compensates for changes in air temperature, such changes otherwise causing undesirable variations in the measured distance. The measured distance between the control device and the datum is then compared to the preset reference distance, as mentioned above, to provide an error signal corresponding to the difference between such measured and reference distances. In response to the error signal, electronic signals ar generated to control the hydraulic cylinders which, in turn, control the position or height of the leveling instrument as described above.

The sonic control device is mounted on the screed positioning members (or alternatively two sonic control devices may be used, one mounted on each of the pair of screed positioning members) and may be moved along such member between the screed and the hydraulic cylinder in order to adjust the sensitivity of the device. For example, consider the case where the pivot point of the positioning member is disposed relatively close to the leveling instrument (i.e. relatively far from the hydraulic cylinder). In this case, a relatively large displacement by the hydraulic cylinder will provide a relatively small corresponding displacement of the leveling instrument. Thus, the sensitivity of the grade control device to movement of the hydraulic cylinder is greater when such device is disposed adjacent to the cylinder and this increased sensitivity yields faster response times and reduces overshoot. In this way, the quality (i.e. smoothness) of the road can be adjusted by moving the grade control device along the positioning member.

The sonic control device includes a microprocessor and provides a feature whereby the reference distance, once set, may be adjusted without having to re-initialize the grade control device. Such adjustments may be desirable in situations where special requirements of an area of paving necessitate a slightly thinner or thicker road surface, for example. Furthermore, it may be desirable to adjust the reference distance in situations where the level of the road surface varies significantly between the location of the control device and the location of the leveling instrument. The reference distance may be adjusted, for example, by using a switch in which the increment of adjustment is fixed, or alternatively, by using a rotary knob. The drawback of using a switch is that the fixed increment should be small enough to allow fine adjustments to be made; however, such a small increment may be inconvenient in applications where relatively large adjustments are desired quickly. Furthermore, the rotary knob may be undesirable since the operator generally has no means of knowing the increment of adjustment corresponding to a given angular displacement of the knob until the leveling instrument moves. Such trial and error adjustment may result in overshoot of the leveling instrument with respect to the desired distance to the datum or in excessively slow adjustment due to the operator's caution in turning the knob slowly to avoid overshoot.

Another aspect of the sonic control device is a deadband feature which permits a predetermined range of error signal values to be overlooked by the control device. Stated differently, the grade control device will not adjust the position of the leveling instrument unless the error signal is greater than a predetermined threshold. This feature is particularly desirable in applications where the datum has small ripples in its surface, for example, in the case of a road bed providing such datum. Because the ripples are small, the resulting error signal is small. Thus, by having a deadband feature, such small error signals may be ignored or disregarded. In other words, the hydraulic cylinders, and thus the leveling instrument, will not move or track the small ripples in the road bed datum. As a result, the ripples is the road bed will not cause corresponding ripples in the newly paved surface. However, the predetermined threshold level below which the error signals are ignored is generally pre-programmed into the microprocessor and, thus, cannot be adjusted by the operators of the paving equipment at the work site. Alternatively, such threshold level may be modified by adjusting a potentiometer, for example. However, generally the operator adjusting such potentiometer has no means of determining the actual deadband value (i.e. predetermined threshold level) and, thus, must use a trial and error process to establish the desired deadband.

As is also known in the art, a mechanical support or bracket positions the target at a predetermined, or target distance from the control device. If the target distance were to change prior to the reference distance being set, the preset reference distance would not accurately represent the actual distance between the sonic sensor and the datum. In such circumstances, the control device would still maintain the desired reference distance between the screed and the datum since both the reference distance and the distance measured between the control device and the datum are determined using the target distance. However, the reference distance is generally continuously displayed, for example with an LCD display and thus, the discrepancy between the actual distance between the control device and the datum when the device is initialized and that displayed as the reference distance may cause the operator some concern.

SUMMARY OF THE INVENTION

It is an object of the present invention to provide improved road construction apparatus.

It is another object of the present invention to provide road construction apparatus having an improved grade control device.

A further object of the present invention is to provide road paving apparatus with a grade control device having non-contacting means for measuring the distance to a datum.

A further object of the invention is to provide a grade control device having a deadband feature which is field configurable, or adjustable at the work site.

Yet another object is to provide a feature whereby the reference distance, set by the operator during initialization of the grade control device and used during operation to measure the distance to a datum, may be changed by an adjustable increment, such increment being adjustable at the work site.

Another object of the invention is to provide a calibration feature to compensate for changes in the target device between the control device and the target, such distance being used to measure the distance between the control device and a datum.

It is yet another object of the invention to provide several modes of operation for a grade control device such that different features of the device are operable in different modes.

A still further object of the invention is to provide a field configurable grade control device providing error messages to a display to alert the operator of various conditions.

In accordance with the present invention, a road paver includes a leveling instrument, means coupled to the leveling instrument for changing the position of the leveling instrument, and a controller for controlling the position changing means. The controller includes a sonic device for transmitting sonic signals and receiving reflections of the sonic signals and means responsive to the sonic device for providing a reference signal corresponding to the round trip travel time of a sonic signal between the sonic device and a datum. The controller further includes means for adjusting the reference signal by a predetermined increment and a display for displaying the predetermined increment. Also provided is an operator actuable device for adjusting the predetermined increment. With this arrangement, the reference signal which is used by the controller for measuring the distance between the leveling instrument and the datum can be adjusted. In particular, during operation, it may desirable to adjust the reference signal, which may be converted into a corresponding reference distance, without manually re-setting the position of the leveling instrument, as is generally done during initialization of the paver. This feature is particularly desirable since, in certain applications, fine adjustments to the reference signal are desired during operation. However, in other instances, for example where the road surface varies significantly between the location of the leveling instrument and the sonic device, it may be desirable to make significant adjustments in the reference signal rather quickly during operation. Thus, by adjusting the predetermined increment, both above-described situations can be accommodated.

In accordance with a further feature of the present invention, apparatus for controlling the position of a paving machine leveling instrument relative to a datum includes a sonic device for transmitting sonic signals and receiving reflections of the sonic signals. The apparatus further comprises a sonic target disposed at a predetermined target distance from the sonic device and a memory device for storing the target distance. A device responsive to the sonic means measures first and second time periods wherein the first time period corresponds to the round trip travel time of a sonic signal between the sonic device and the target and the second time period corresponds to the round trip travel time of a sonic signal between the sonic device and the datum. The apparatus further includes means responsive to the stored target distance and the first and second time periods for providing a corresponding to the distance between the sonic device and the datum. Also provided is means responsive to the datum distance signal and a reference signal for providing a signal for controlling the height of the paving machine leveling instrument and an operator actuable device for modifying the stored target distance. With this arrangement, changes in the target distance can be compensated in the field. In other words, if the mechanical support or bracket which maintains the distance becomes bent, for example, before the control device is initialized, the reference distance which is generally displayed will not correspond to the actual distance between the sonic device and the datum. Thus, the calibration feature, whereby the stored target distance may be adjusted, allows compensation for changes in such target distance.

In accordance with a further feature of the present invention, apparatus for controlling the position of a paving machine leveling instrument relative to a datum comprises a sonic device for transmitting sonic signals and receiving reflections of the sonic signals and a sonic target. The apparatus further includes means for responsive to the sonic device for measuring first and second time periods wherein the first time period corresponds to the round trip travel time of a sonic signal between the sonic device and the target and the second time period corresponds to the round trip travel time of a sonic signal between the sonic device and the datum. Means responsive to the first and second time periods provides a datum distance signal corresponding to the distance between the sonic means and the datum. A comparator responsive to the datum distance signal and a reference signal determines the difference between such signals and provides a control signal in response to such difference. The apparatus further includes a positioning device responsive to the control signal being above a predetermined threshold value for moving the leveling instrument and means for adjusting the predetermined threshold value. A display indicates the predetermined threshold value. With this arrangement, the apparatus includes a deadband feature in accordance with which the apparatus will not respond to the difference between the datum distance signal and the reference signal being below a predetermined threshold value. The predetermined threshold value corresponds to a deadband value and is displayed when such value is adjusted. This arrangement enables operators of the paving equipment to adjust such deadband value at the work site.

BRIEF DESCRIPTION OF THE DRAWINGS

The foregoing features of this invention, as well as the invention itself, may be more fully understood from the following detailed description of the drawings in which.

DESCRIPTION OF THE PREFERRED EMBODIMENTS

Figure 1:
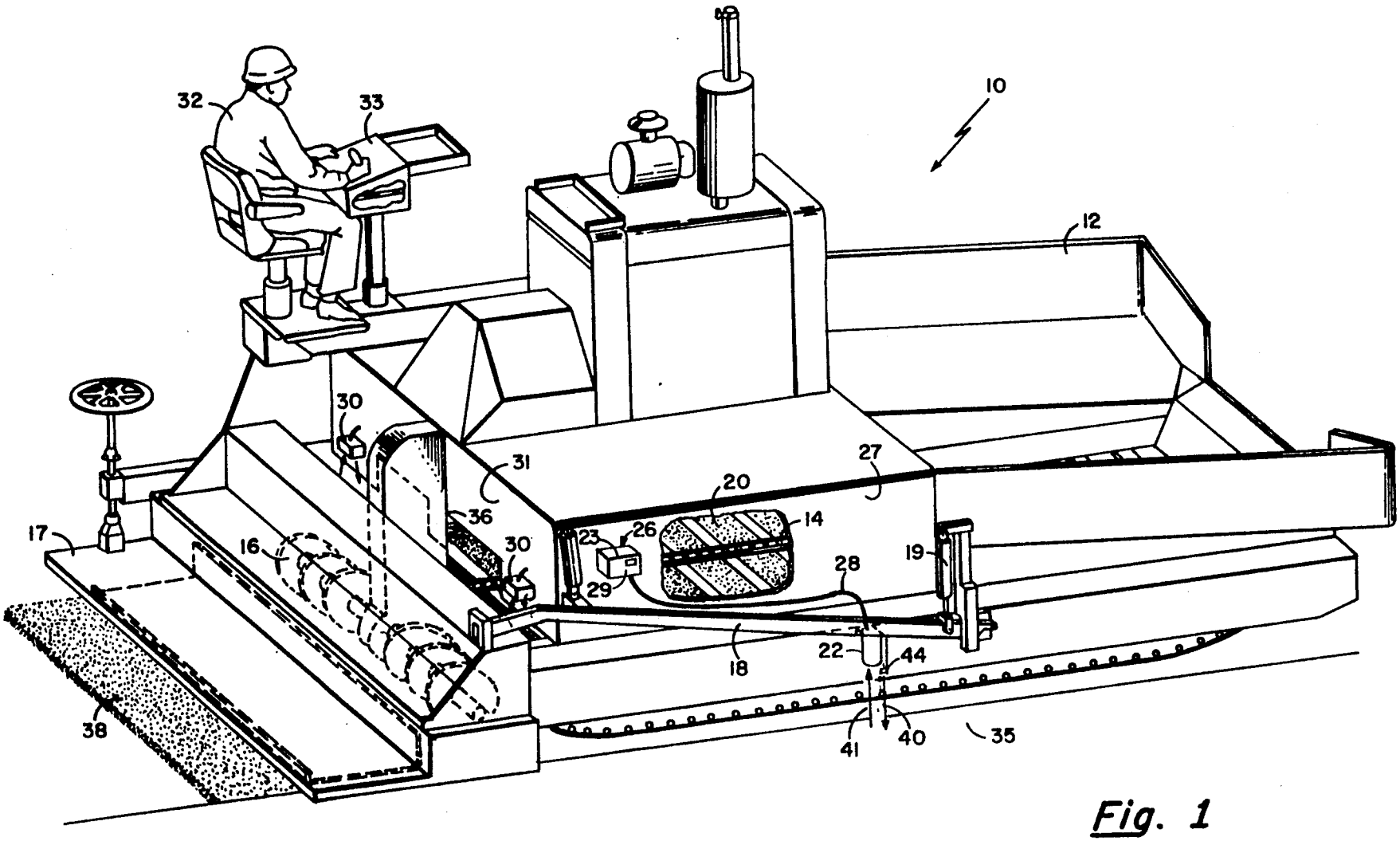
FIG. 1 is a perspective view of an asphalt paving machine having a grade control device in accordance with the present invention installed thereon.

Referring now to FIG. 1, a paving machine 10 includes a hopper 12, a conveyer 14, an auger 16, a screed or grading instrument 17, and a screed positioning member or mechanism 18. Asphalt 20 is deposited in the hopper 12 which is located at the front of paving machine 10. Conveyer 14 is disposed beneath hopper 12 and the delivers asphalt 20 from hopper 12 to the back of paving machine 10. Disposed behind conveyer 14 and connected to paving machine 10 is auger 16, as shown. The screed 17 is disposed behind the paving machine 10 and is attached thereto by screed positioning member 18. A hydraulic cylinder 19 is disposed between a side panel 27 and screed positioning member 18, as shown. Disposed on a side (not shown) of paver 10 opposite side panel 27 is a hydraulic cylinder and screed positioning member similar to cylinder 19 and member 18, shown here.

Figure 2:
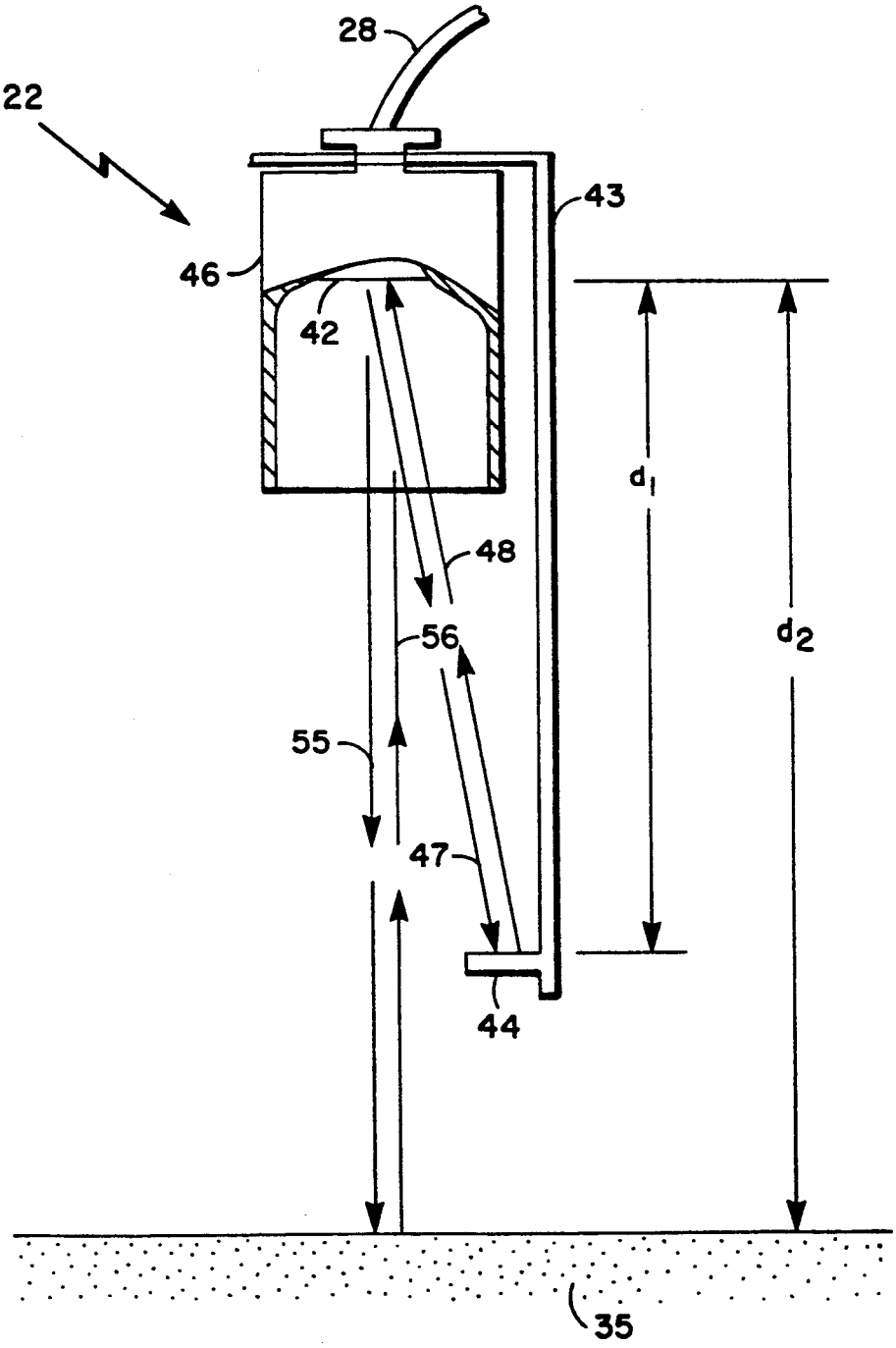
FIG. 2 is a partially cut-away view of the screed sensor of the grade control device shown in FIG. 1.

A grade control device 26 is disposed on paver 10 and includes a screed sensor 22 attached to member 18 by any suitable means and a control box 23 attached to side panel 27 of paving machine 10 also by any suitable means, as shown. Control box 23 has a control panel 29 disposed thereon. Referring now also to FIG. 2, screed sensor 22 includes a mechanical support or bracket 43 to which a target 44 is attached. Screed sensor 22 further includes a transducer 42 disposed within a plastic housing 46. Here, transducer 42 is an electrostatic transducer manufactured by Polaroid Corporation of Cambridge, Mass., Part No. 8667. Target 44 is disposed at a predetermined, or target distance $d_1$ away from transducer 42, for example six inches. Screed sensor 22 is coupled to control box 23 by a cable 28. In response to changes in the distance between the screed sensor 22 and a datum 35, screed sensor 22 provides electrical signals to change the horizontal position of screed 17, as will be described.

Here, two auger sensors 30 are disposed on a back panel 31 of paving machine 10. Auger sensors 30 generate control signals which adjust the rotational velocity of auger 16 in response to changes in the distance between such sensors 30 and asphalt 20 disposed therebelow. The operation of sonic auger sensor 30 is described in detail in U.S. Pat. No. 4,933,853 entitled "Ultrasonic Grade and Auger Control" and incorporated herein by reference. Suffice it here to say that each auger sensor 30 provides electrical signals similar to those described hereinafter in conjunction with screed sensor 22. Furthermore, such auger sensor 30 generated signals can be used in conjunction with control box 23, the operation of which will be described hereinafter.

Seated at the top of paving machine 10 is an operator 32 who controls the speed and direction of paving machine 10 through control circuitry 33, as is conventional. Generally, an additional operator (not shown) walks alongside paving machine 10 and, in particular, on the side where grade control device 26 is disposed. It should be noted that in some applications it may be desirable to have a duplicate screed sensor (not shown) on the side of road paving machine 10 opposite side panel 27 in order to more accurately control the level of screed 17.

Datum 35 is disposed along the side of the road and may be a string line or the actual road surface, for example. Essentially, the datum 35 is whatever reference surface that the operator 32 desires the grade of the paved road to match, or track. For example, an alternative datum arrangement may be the ski-like structure, as described in the above referenced patent.

In operation, asphalt 20 is deposited into hopper 12 and is moved toward the back of paving machine 10 by conveyor 14. The asphalt 20 is directed through a slit 36 in the back panel 31 of paving machine 10 to the auger 16. When asphalt 20 falls from conveyor 14, a control mechanism (not shown) causes auger 16 to rotate and distribute the asphalt 20 to the sides of the road bed 38. As paver 10 moves forward, screed 17 moves over the asphalt 20 thereby flattening it to form a smooth road surface 38.

As paving machine 10 travels along the road surface 38, the distance between datum 35 and screed sensor 22 is measured at a rate of approximately thirty times per second, in the manner described in detail in U.S. Pat. No. 4,933,853, and hereinafter in conjunction with FIGS. 2 and 3. Suffice it here to say however, that the measured distance is compared to a preset reference signal corresponding to the distance between the sensor 22 and the datum 35. In response to the difference between such distances, an error signal is generated. The error signal is used to generate control signals which activate hydraulic cylinder 19 to adjust the level of screed 17.

Figure 3:
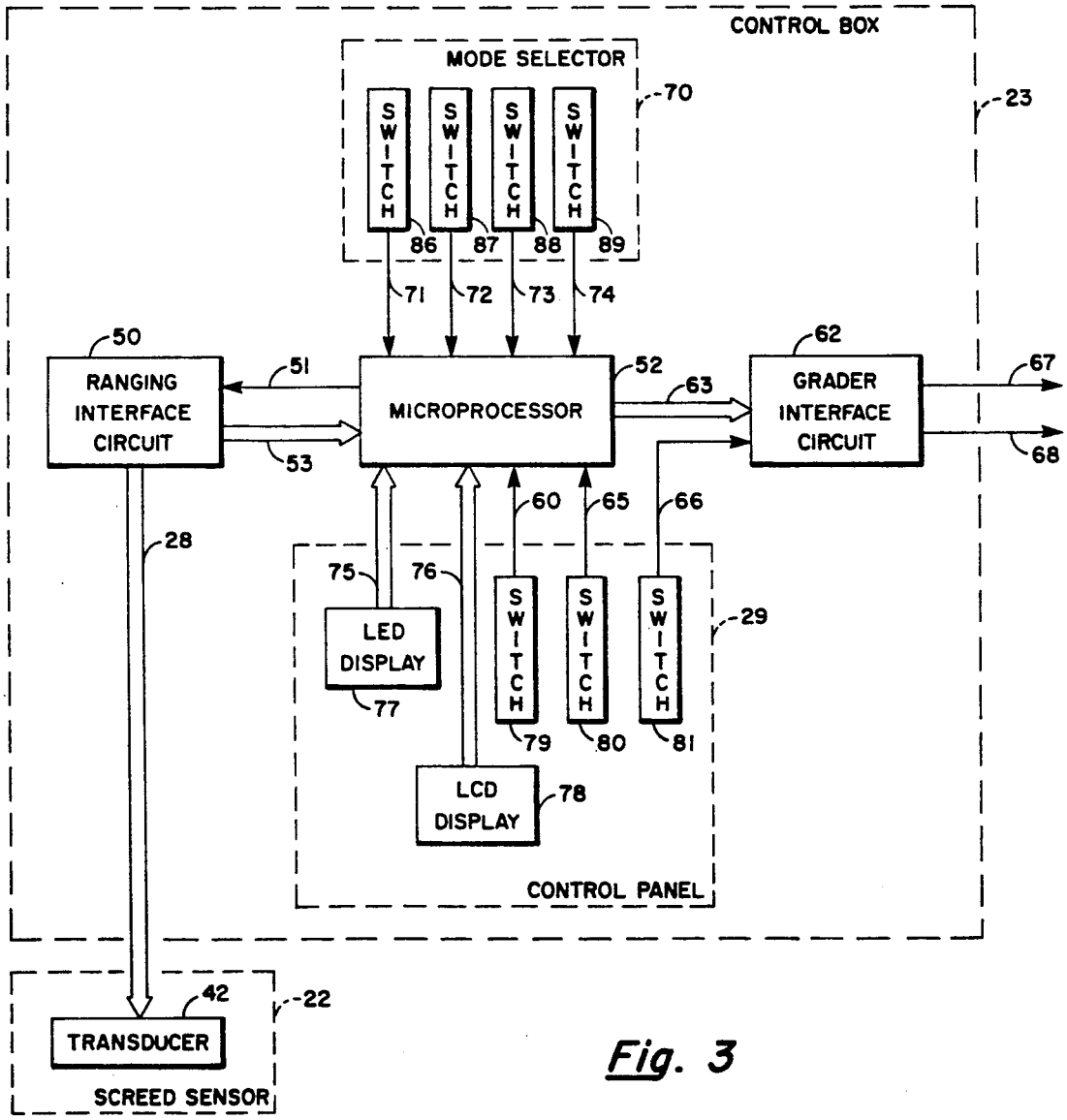
FIG. 3 is a block diagram of a grade control device in accordance with the present invention.

Referring now also to FIGS. 2 and 3, the manner of measuring the distance between screed sensor 22 and datum 35 will be described. In operation, in response to a periodic control signal, transducer 42 transmits a sonic signal downward toward target 44, as shown by arrow 47. This transmitted sonic signal reflects off of the target 44 and is received by transducer 42, as shown by arrow 48. The periodic control signal is provided to transducer 42 by circuitry within control box 23 via cable 28. Furthermore, the received sonic signal is transmitted to control box 23 by cable 28.

More particularly, transducer 42 is coupled to a ranging interface circuit 50 disposed inside control box 23. Here, ranging interface circuit 50 is an SN28827 ranging module manufactured by Texas Instruments of Dallas, Tex. In response to a control signal provided by a microprocessor 52 to ranging interface circuit 50 via signal line 51, such circuit transmits the periodic control signal to transducer 42 by cable 28. Microprocessor 52 is, here, manufactured by Motorola, Inc. of Phoenix, Ariz., Part No. 688C811, and contains an internal ROM, RAM, and non-volatile memory (EEPROM). In response to the receipt of the reflected sonic signal, ranging interface circuit 50 generates a first digital timing signal corresponding to the time duration between transmission and receipt of the sonic signal to target 44. The digital timing signal is coupled to microprocessor 52 by a signal bus 53.

Transducer 42 further transmits a sonic signal downward toward datum 35, as shown by arrow 55, and receives the sonic signal reflected upward from datum 35, as shown by arrow 56. Again such received sonic signal is transmitted to ranging interface circuit 50 via cable 28. In response to the receipt of this reflected sonic signal, ranging interface circuit 50 generates a second digital timing signal corresponding to the time duration between transmission and receipt of the sonic signal to datum 35. The second digital timing signal is coupled from ranging interface circuit 50 to microprocessor 52 via signal bus 53.

In response to the first digital timing signal (i.e. corresponding to a first time interval between transmission and receipt of the sonic signal between transducer 42 and target 44) and the second digital timing signal (i.e. corresponding to a second time interval between transmission and receipt of a sonic signal between transducer 42 and datum 35), microprocessor 52 measures the distance between transducer 42 and datum 35. More particularly, the target distance $d_1$ is stored in microprocessor 52. The distance $d_2$, between transducer 42 and datum 35, is equivalent to the quantity of the target distance $d_1$ divided by the first time interval, such quantity multiplied by the second time interval.

Microprocessor 52 then compares the measured distance $d_2$ to a reference signal. More particularly, a reference signal, which may be translated into a reference distance, is set by the operator of the paver 10, as will be described hereinafter. Suffice it here to say that the reference signal corresponds to the distance between transducer 42 and datum 35 which is measured and stored in microprocessor 52 when the control device 26 is set up, or initialized. In response to the comparison of measured distance $d_2$ to the reference distance, microprocessor 52 generates an error signal, corresponding to the difference between such signals or distances, and transmits such error signal to a grader interface circuit 62 via a signal bus 63. More particularly, if the difference between the measured distance $d_2$ and the reference distance is within a first distance interval, then the error signal provided to grader interface circuit 62 indicates that leveling instrument 17 is to be moved upwardly. If the difference between the measured distance $d_2$ and the reference distance is within a second distance interval, then the error signal provided to grader interface circuit 62 indicates that the leveling instrument 17 is to be moved downwardly. Furthermore, in accordance with a deadband feature, described in detail below, if such difference is within a third distance interval, then the error signal provided to grader interface circuit 62 indicates that the leveling instrument 17 is to remain at the same position.

Grader interface circuit 62 is coupled to hydraulic cylinder 19 by interface signal lines 67 and 68. More particularly, one of the interface signal lines, here signal line 67, communicates with hydraulic cylinder 19 to move screed 17 upwardly and the other interface signal line, here signal line 68, communicates with hydraulic cylinder 19 to move such screed 17 downwardly. The amount that hydraulic cylinder 19 is moved upward or downward by the signals carried by signal lines 67 and 68, respectively, corresponds to the pulse length of such signals.

A mode selector 70 is coupled to microprocessor 52 and provides means for selecting various modes of operating the grade control device 26, as will be described in conjunction with FIGS. 4 and 5. Suffice it here to say that mode selector 70, here, includes four switches 86–89, each one of such switches 86–89 being positioned in a first or a second position and coupled to a separate input of microprocessor 52 by signal lines 71–74, respectively. With the four toggle switches 86–89, mode selector 70 is thus capable of selecting between sixteen modes of operation. Alternatively, two switches could be used in order to select between the four modes of operation of control device 26 described hereinafter.

Figure 4:
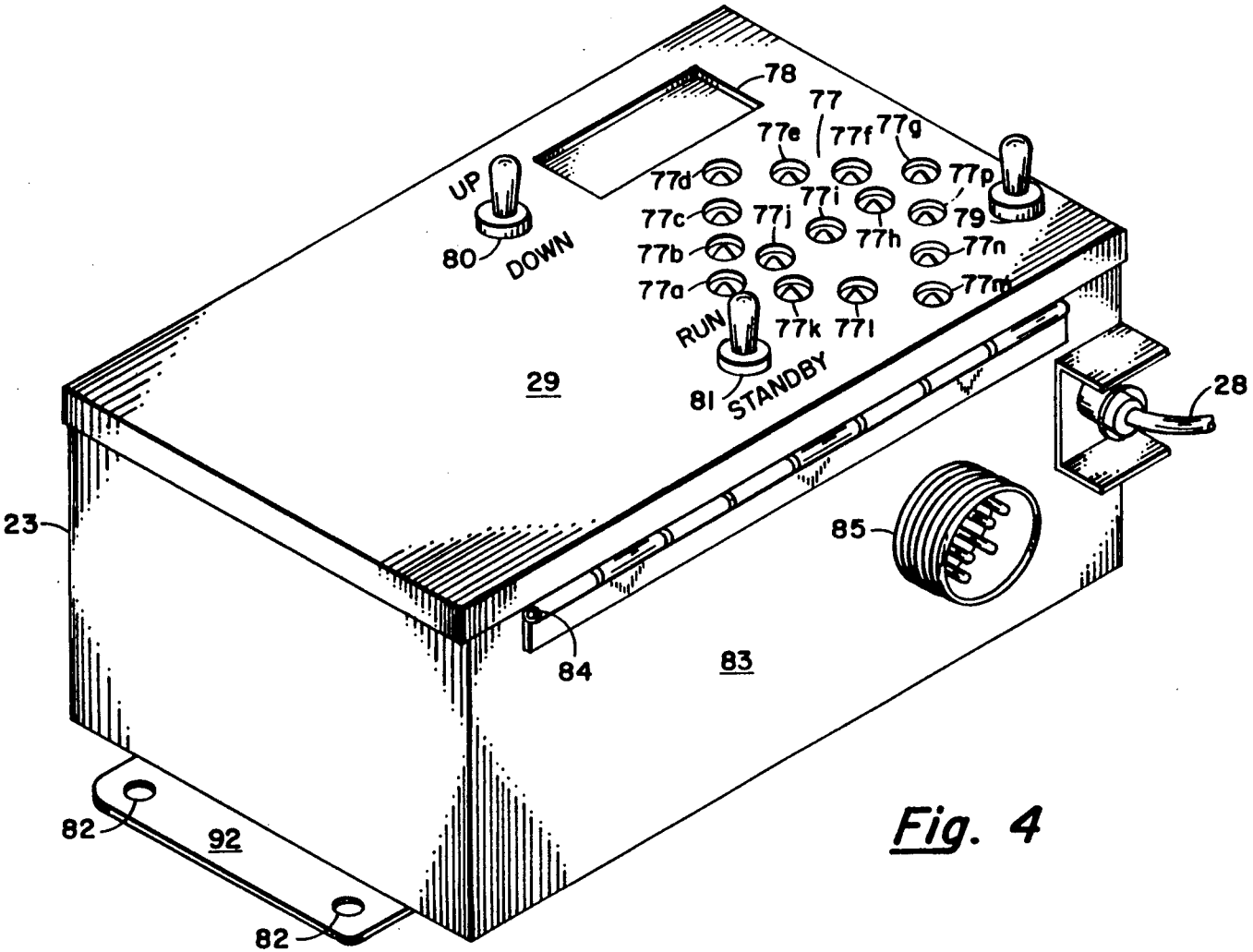
FIG. 4 is an isometric view of the control box of the grade control device shown in FIG. 1.

Referring now also to FIG. 4, control box 23 is shown. As mentioned above, in conjunction with FIG. 1, control box 23 is attached to the side panel 27 of paver 10 by any suitable means. For example, control box 23 may be screwed or bolted to side panel 27 by screws or bolts (not shown) disposed through apertures 82 of flanges 92 (only one of which is shown in FIG. 4). Control box 23 includes control panel 29 having an LED display arrangement 77 and a LCD display 78 disposed thereon. Disposed inside control box 23 is, inter alia, microprocessor 52, ranging interface circuit 50, grader interface circuit 62, and mode selector 70. Microprocessor 52 is coupled to LED display arrangement 77 via signal bus 75 (FIG. 3). Signal bus 75 represents several signal lines coupled to the individual LEDs *77a–77o* of display arrangement 77 to light such LEDs *77a–77o*, as will now be described. In the case described above where the error signal indicates that screed 17 is to be moved upwardly, LEDs *77a–77g* are activated, or lit, to indicate such a change in position of the screed 17. If the error signal indicates that screed 17 is to be moved downwardly, then LEDs *77a*, *77g*, and *77k–77o* are lit. Furthermore, if the error signal indicates that no change in the position of screed 17 is required, then LEDs *77a* and *77g–77j* will be lit. In this way, the LED display arrangement 77 indicates to the operator of paver 10 the direction in which screed 17 is being moved.

Microprocessor 52 is also coupled to LCD display 78 via signal bus 76. Display 78 serves several purposes, one of which is to provide a convenient read out for error messages indicating various conditions. More particularly, numerical digits may be displayed with each digit corresponding to an error message and with a legend being provided on the face of control panel 29 or perhaps in an owners manual to correlate each digit with a particular error message. For example, the digit "1" may be displayed to indicate that the cable 28 has been severed and the digit "2" may indicate that the datum 35 is outside of the range of transducer 42. Additional error indications which might be desirable are that the hydraulic cylinder 19 is not responding to the control signals provided thereto by interface signal lines 67 and 68 or that the difference between the reference distance as initially set and the displayed reference distance is greater than a predetermined amount (i.e. as in the case of the predetermined distance $d_1$ changing, as described above).

Control panel 29 is attached to a side wall 83 of control box 23 by a hinge 84. With control panel 29 hingedly connected to side wall 83, such control panel 29 may be lifted to expose the electronics, such as ranging interface circuit 50, microprocessor 52, grader interface circuit 62, and mode selector 70, contained within control box 23. Disposed on side wall 83 is a power connector 85 through which a conventional DC power source provides power to the electronics disposed therein. Cable 28 couples screed sensor 22 (FIG. 1) to control box 23, and more particularly to ranging interface circuit 50, through side wall 83, as shown.

Control panel 29 has three switches 79–81 disposed thereon. Switch 79 is a center returning momentary switch which is used to set the reference distance and may be referred to as a NULL switch 79. Another center returning momentary switch 80 is used to increment various parameters, as will be described. Toggle switch 81 is used to select between a RUN mode for normal operation, or a STANDBY mode, as will be described.

In operation, when the screed sensor 22 is initially attached to screed positioning member 18 as desired, for example at the beginning of a work day or a paving job, and the datum 35 is chosen, the operator 32 activates the NULL switch 79. NULL switch 79 is coupled to microprocessor 52 by signal line 60 (FIG. 3). Upon activation of such switch 79, microprocessor 52 measures the distance between transducer 42 and datum 35, in the manner described above, and stores such measured distance in its non-volatile memory to initialize control device 26. The RUN/STANDBY switch 81 may be in either the RUN or STANDBY position during initialization of control device 26; however, once operator 32 is ready to begin paving, switch 81 should be placed in the RUN position. In the RUN mode, the reference distance which was measured and stored when NULL switch 79 was activated, is displayed on LCD display 78.

During a routine paving operation, switch 81 is kept in the RUN position. However, it may be desirable to move switch 81 to the STANDBY position at certain times during the paving operation. More particularly, switch 81 is coupled to grader interface circuit 62 via signal line 66 such that when switch 81 is disposed in the STANDBY position, grader interface circuit 62 ceases to provide control signals to hydraulic cylinder 19 via signal lines 67 and 68. In other words, during STANDBY mode operation, the control device 26 is effectively disconnected or de-coupled from the hydraulic cylinder 19.

During RUN mode operation, the distance between the transducer 42 and the datum 35 is measured and such measured distance compared to the reference distance, as described above, thirty times per second to provide the error signal to grader interface circuit 62. During such RUN mode operation, it may be desirable to adjust the reference distance without manually resetting the position of screed 17 and activating NULL switch 79. Increment switch 80 is coupled to microprocessor 52 by signal line 65 (FIG. 3) and may be used to make such adjustments to the reference distance. Such adjustment is achieved during RUN mode operation by simply moving switch 80 in the direction indicated on control panel 29 corresponding to the desired direction for movement of screed 17. For example, in order to increase the reference distance (i.e. move the screed 17 upward), switch 80 is moved upward. Alternatively, to decrease the reference distance (i.e. move the screed 17 downward), switch 80 is moved downward.

RUN/STANDBY mode operation of grade control device 26 provides a first mode of operation. More particularly, grade control device 26 is operable in such RUN mode (or STANDBY mode) when mode selector switches 86–89 are in a first position, corresponding to the digital signals carried by signal lines 71–74 being in a first logic state.

A second mode of operation, here, a calibration mode, is operable when mode selector switch 86 is in a second position corresponding to the digital signal carried by signal line 71 being in a second logic state and switches 87–89 are in the first position such that the logic signals carried by lines 72–74 are in the first logic state. Control device 26 is also operable in a third mode, hereinafter referred to as a deadband adjustment mode, when mode selector switch 87 is in the second position and switches 86, 88, and 89 are in the first position. Furthermore, a fourth mode of operation, or an increment adjustment mode, may be selected by providing mode selector switches 86 and 87 in the second position and switches 88 and 89 in the first position. Note that any convenient positioning arrangement of switches 86–89 to select between the four above-mentioned modes of operation may alternatively be implemented.

Figure 5:
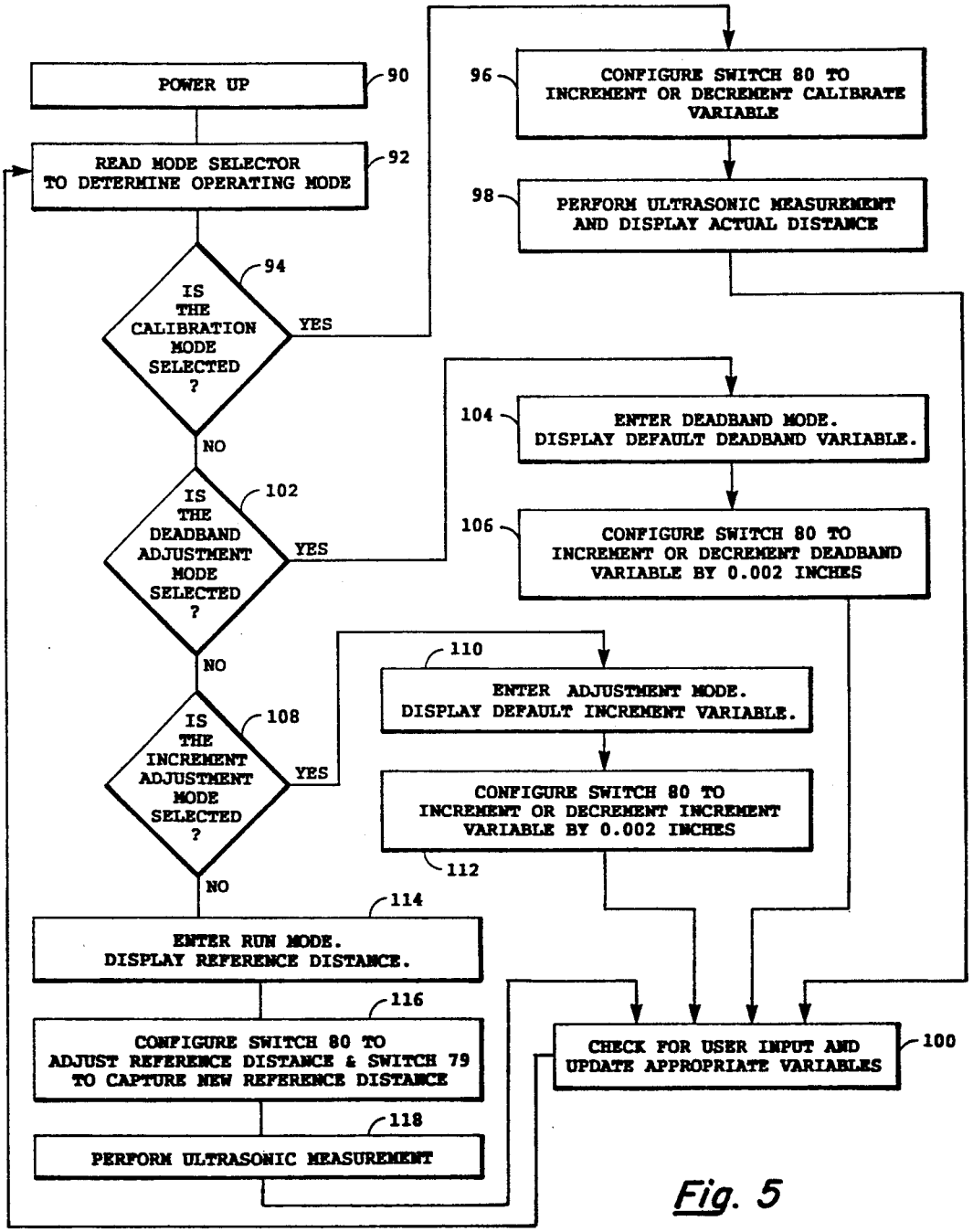
FIG. 5 is a flow chart of the operation of the grade control device of the present invention.

Referring now also to FIG. 5, the operation of grade control device 26, and more particularly of microprocessor 52, will be described in conjunction with each of the various modes of operation. In microprocessor step 90, a power on/reset signal is generated which causes a reset pin of microprocessor 52 to be held in a low logic state until the power provided to control device 26 through connector 85 is stable. The reset pin is then released and microprocessor 52 is initialized by clearing internal registers, clearing interrupts, setting the outputs to a logic low state, and loading the code from internal ROM to RAM. Microprocessor 52 then executes step 92 in which the mode selector 70 is monitored to determine the selected operating mode. In particular, in step 94, microprocessor 52 determines whether switches 86–89 of mode selector 70 are positioned to select the calibration mode.

During the calibration mode, any necessary adjustments to the target distance $d_1$ between target 44 and transducer 42 are made. In other words, consider again the case where the mechanical support 43 (FIG. 2) becomes bent before the control device 26 is initialized (i.e. the operator 32 sets the reference distance as desired by activating NULL switch 79). In this case, the reference distance shown on display 78 during RUN mode operation will not correspond to the actual distance (were the operator 32 to measure it) between transducer 42 and datum 35. While the operation of grade control device 26 will remain accurate (i.e. since there will be a corresponding difference between the actual and measured RUN mode distance between transducer 42 and datum 35), the discrepancy between the measured and actual reference distances may cause the operator 32 concern. Thus, calibration mode operation is provided to permit the operator 32 to compensate for changes in the target distance $d_1$.

Consider the case where such switches 86–89 are positioned to select calibration mode operation. In this case, step 96 is next executed in which microprocessor 52 configures switch 80 to increment or decrement a calibration variable (i.e. the target distance $d_1$ between transducer 42 and target 44) by a preset amount, for example by 0.002 inches. Microprocessor 52 next executes step 98 in which the distance between transducer 42 and datum 35 is measured and is displayed on LCD display 78. In step 100, if the operator 32 of grade control device 26 determines that such displayed measured distance does not correspond to the distance that he or she measures between the transducer 42 and the datum 35, such operator 32 displaces switch 80 as necessary until such distances correspond. More particularly, every time switch 80 is displaced upward, the target distance $d_1$ increases, for example by 0.002 inches and likewise, when such switch 80 is displaced downward, the target distance $d_1$ is decreased by such increment. Note that the target distance $d_1$ is not displayed; however, the reference distance is displayed and will reflect changes to the target distance $d_1$ in accordance with the equation set forth above, by which such reference distance is measured. After each displacement of switch 80, the up dated calibration variable, or target distance $d_1$ is stored in memory by microprocessor 52.

Microprocessor 52 then re-executes the step 92 in which the mode selector 70 is again monitored to determine which operating mode is chosen. Consider the case where the switches 86–89 of mode selector 70 are now positioned to select the second, or deadband adjustment mode operation. In this mode of operation, the deadband value (i.e. the predetermined threshold level below which error signal values will be ignored) is displayed on LCD display 78 and operator 32 is able to adjust the deadband distance value as desired.

In the case where deadband mode operation is selected, the outcome of step 94 is negative and thus microprocessor 52 executes step 102 in which it is determined that the deadband adjustment mode has been selected. Subsequently, microprocessor 52 executes step 104 in which display 78 indicates the mode of operation of control device 26 by displaying the letter "D" in the left portion of such display 78. Also, displayed is a default deadband variable which is pre-programmed into microprocessor 52. Increment switch 80 is then configured, in step 106, to increment or decrement the deadband variable by 0.002 inches. Following step 106, microprocessor step 100 is re-executed and user inputs are monitored. For example, if operator 32 displaces switch 80 upward, the deadband variable shown on display 78 is increased, here by 0.002 inches. Also during step 100, the updated deadband variable is stored in memory.

Again, after step 100, microprocessor 52 re-executes step 92 to determine the selected operating mode. Consider next the case where the switches 86–89 of mode selector 70 are positioned to select the increment adjustment mode. In this case, the result of steps 94 and 102 are negative. Step 108 is then executed, in which it is determined that the increment adjustment mode of operation has been selected.

The purpose of the increment adjustment mode is to permit the operator 32 to select an increment value with which the reference distance may then be adjusted during RUN mode operation, as described above. This feature is particularly desirable since, in certain applications, fine adjustments to the reference distance are required during operation. However, in other instances, for example, where the slope of the road surface varies significantly between the location of screed sensor 22 and screed 17, it may be desirable to make significant adjustments in the reference distance rather quickly during operation. In such a case, having each displacement of switch 80 provide only small changes to the reference distance may not be suitable since numerous displacements of switch 80 would be required to achieve the desired reference distance adjustment, and, thus, such adjustment could not be made quickly. Thus, the increment adjustment mode of operation permits the operator 32 to choose a desired increment to be associated with each displacement of switch 80 during RUN mode operation and, thus, accommodate both situations described above.

In response to the determination that the increment adjustment mode has been selected, microprocessor 52 executes step 110 in which the letter "A" is displayed in the left portion of display 78 to indicate that the control device 26 is in the increment adjustment mode. Also shown on display 78 is a default increment variable, having been pre-programmed into microprocessor 52. Subsequently, step 112 is executed in which switch 80 is configured to increment or decrement the default increment variable by 0.002 inches. Following step 112, step 100 is re-executed and user inputs are monitored. By displacing switch 80 upward or downward, the default increment variable is changed accordingly and the updated increment variable is stored in memory for use when RUN mode operation is resumed.

Again, step 92 is re-executed after step 100 and the mode selector 70 is monitored. Consider the case when RUN mode operation is selected by the positioning of the switches 86–89 of mode selector 70, as described above. In this case, the outcome of each of steps 94, 102, and 108 is negative, and microprocessor 52, thus, executes step 114. As described above, during RUN mode operation, the reference distance is shown on display 78. Such reference distance corresponds to the distance between transducer 42 and datum 35 stored at the time when NULL switch 79 was last activated or when switch 80 was last activated during RUN mode operation to adjust the reference distance. Following step 114, switch 80 is configured to adjust the reference distance and NULL switch 79 is configured to measure and store a new reference distance, in step 116. Once switch 80 has been configured in step 116, the distance between transducer 42 and datum 35 is measured, in step 118, to generate the control signals provided to grader interface circuit 62 by signal bus 63, as described above. Step 100 is re-executed after measurement step 118, and the user inputs are monitored. For example, in the case where operator 32 adjusts the reference distance during RUN mode operation, such reference distance variable is updated in the memory of microprocessor 52.

Having described preferred embodiments of the invention, it will now become apparent to one of skill in the art that other embodiments incorporating their concepts may be used. For example, it should be appreciated that other sensors like auger sensor 30, generating and being responsive to signals like those carried by cable 28, may be coupled to control circuitry substantially identical to that contained in control box 23. In other words, screed sensor 22 could be replaced with auger sensor 30 and grader interface circuit 62 could be replaced with an auger interface circuit, the output of which is a signal controlling the rotation of auger 16. Alternatively, both an auger sensor 30 as well as a screed sensor 22 may be coupled to a single control box, modified to accommodate control of the rotation of auger 16 as well as the position of leveling instrument 17. It is felt, therefore, that these embodiments should not be limited to disclose embodiments but rather should be limited only by the spirit and scope of the appended claims.

What is claimed is:

1. A road paver comprising:

a leveling instrument;

means coupled to said leveling instrument for changing the position of said leveling instrument; and means for controlling said position changing means, said controlling means comprising:

a) sonic means for transmitting sonic signals and receiving reflections of said sonic signals;

b) means responsive to said sonic means for providing a reference signal corresponding to the round trip travel time of a sonic signal between said sonic means and a datum;

c) means for adjusting said reference signal by a predetermined increment;

d) means for displaying said predetermined increment; and e) operator actuable means for adjusting said predetermined increment.

2. The road paver recited in claim 1 wherein the means for changing the position of said leveling instrument comprises a hydraulic cylinder.

3. The road paver recited in claim 1 wherein said reference signal providing means comprises a microprocessor.

4. Apparatus for controlling the height of a paving machine leveling instrument relative to a datum, said apparatus comprising:

sonic means for transmitting sonic signals and receiving reflections of said sonic signals;

a sonic target;

means for storing a predetermined value corresponding to the distance between said sonic means and said target;

means responsive to said sonic means for measuring first and second time periods wherein the first time period corresponds to the round trip travel time of a sonic signal between said sonic means and said target and the second time period corresponds to the round trip travel time of a sonic signal between said sonic means and said datum;

means responsive to said stored target distance value and said first and second time periods for providing a datum distance signal corresponding to the distance between said sonic means and said datum;

means responsive to said datum distance signal and a reference signal for providing a signal for controlling the height of said paving machine leveling instrument; and operator actuable means for modifying said stored target distance value to calibrate said datum distance signal.

5. The apparatus as recited in Claim 4 wherein the datum distance signal is proportional to said second time period multiplied by said stored target distance value divided by said first time period.

6. Apparatus for controlling the position of a paving machine leveling instrument relative to a datum, said apparatus comprising:

sonic means for transmitting sonic signals and receiving reflections of said sonic signals;

a sonic target;

means responsive to said sonic means for measuring first and second time periods wherein the first time period corresponds to the round trip travel time of a sonic signal between said sonic means and said target and the second time period corresponds to the round trip travel time of a sonic signal between said sonic means and said datum;

means responsive to said first and second time periods for providing a datum distance signal corresponding to the distance between the sonic means and a datum;

comparison means responsive to said datum distance signal and a reference signal for determining the difference between said signals and for generating a control signal in response to said difference;

positioning means responsive to said control signal being greater than a predetermined threshold value for moving said leveling instrument;

means for adjusting said predetermined threshold value; and a display for indicating said predetermined threshold value.

7. A road paver comprising:

a leveling instrument disposed at a predetermined distance from a datum;

means coupled to the leveling instrument for changing the position of said leveling instrument relative t said datum in response to a control signal;

means for controlling said position changing means comprising:

a) sonic means for transmitting sonic signals and receiving reflections of said signals;

b) a sonic target disposed at a predetermined target distance from said sonic means;

c) means responsive to said sonic means for measuring first and second time periods wherein the first time period corresponds to the round trip travel time of a sonic signal between said sonic means and said target and the second time period corresponds to the round trip travel time of a sonic signal between said sonic means and said datum;

d) means responsive to said first and second time periods for providing a datum distance signal corresponding to the distance between the sonic means and the datum;

e) comparison means responsive to said datum distance signal and a reference signal for providing the control signal in response to the difference between said signals;

f) means for adjusting said reference signal by a predetermined increment;

g) means for displaying said predetermined increment;

h) means for modifying said predetermined increment in response to said control means being in a first mode of operation; and i) operator actuable means for selecting said first mode of operation.

8. The road paver recited in Claim 7 wherein said control signal is coupled to said position changing means when said difference is greater than a predetermined threshold value and is de-coupled from said position changing means when said difference is less than said predetermined threshold value.

9. The road paver recited in Claim 8 further comprising means for displaying said reference signal, wherein said control means is operable in a second mode of operation in which said display means displays said predetermined threshold value and said value is adjustable, said control means further comprising second operator actuable means for selecting said second mode of operation.

10. The road paver recited in Claim 7 wherein said control means further comprises a memory device for storing said predetermined target distance between said sonic means and said sonic target and wherein said comparison means is responsive to said predetermined target distance.

11. The road paver recited in Claim 10 wherein said control means is operable in a third mode of operation in which said stored predetermined target distance is adjustable and wherein said control means further comprises third operator actuable means for selecting said third mode of operation.

* * * * *